US008919718B2

(12) United States Patent
Lueker

(10) Patent No.: US 8,919,718 B2
(45) Date of Patent: Dec. 30, 2014

(54) MULTIFUNCTION BEVERAGE CONTAINER HOLDER

(71) Applicant: Mark David Lueker, Loveland, CO (US)

(72) Inventor: Mark David Lueker, Loveland, CO (US)

( * ) Notice: Subject to any disclaimer, the term of this patent is extended or adjusted under 35 U.S.C. 154(b) by 0 days.

(21) Appl. No.: 13/680,094

(22) Filed: Nov. 18, 2012

(65) Prior Publication Data

US 2013/0075351 A1 Mar. 28, 2013

(51) Int. Cl.
*B60R 7/00* (2006.01)
*A47G 23/02* (2006.01)

(52) U.S. Cl.
CPC ..... *A47G 23/0208* (2013.01); *A47G 23/0225* (2013.01); *A47G 2200/143* (2013.01)
USPC ..... 248/311.2; 224/556

(58) Field of Classification Search
CPC ..... A47G 23/02; A47G 23/0208; A47G 23/0216; A47G 23/0225; A47G 23/0266; B60N 3/10; B60N 3/103
USPC ..... 248/311.2, 312.1, 102, 103; 211/85.29; 220/23.83, 475, 574, 575, 737; 206/139, 427, 429; 224/148.7, 556, 224/566, 926; 108/152
See application file for complete search history.

(56) References Cited

U.S. PATENT DOCUMENTS 3,893,569 A * 7/1975 Hoch ..... 211/74
4,961,555 A * 10/1990 Egan, Jr. ..... 248/231.81
5,174,534 A * 12/1992 Mitchell ..... 248/311.2
5,306,029 A * 4/1994 Kaiser, II ..... 280/30
5,603,477 A * 2/1997 Deutsch ..... 248/311.2
5,715,953 A * 2/1998 Brown ..... 211/74
5,918,550 A * 7/1999 Weir et al. ..... 108/42
6,059,138 A * 5/2000 Labruyere ..... 220/574
6,131,779 A * 10/2000 Gendala ..... 224/148.1
6,138,967 A * 10/2000 Okamoto ..... 248/188.1
6,227,511 B1 * 5/2001 De Costa ..... 248/311.2
6,705,240 B2 * 3/2004 Block et al. ..... 108/150
D499,612 S * 12/2004 Smith, Sr. ..... D7/605

(Continued)

FOREIGN PATENT DOCUMENTS

WO WO 2005009184 A1 * 2/2005 ..... A47G 23/02

OTHER PUBLICATIONS

Sofa Butler by Storage Dynamics; http://www.amazon.com/Storage-Dynamics-Sofa-Butler/dp/B0046V34LG/ref=sr_1_1?ie=UTF8&qid=1398874436&sr=8-1&keywords=couch+cupholders; first seen Feb. 1, 2014; 5 pgs.

*Primary Examiner* — Joshua Rodden
(74) *Attorney, Agent, or Firm* — Barbara Campbell; Cochran Freund & Young LLC

(57) ABSTRACT

An apparatus including one or more beverage container receptacles for holding a beverage container in the upright position in multiple convenient and possibly unstable locations is described. Slender legs separate the beverage container receptacles from direct contact with the mounting or bearing surfaces and serve to damp spilling forces transmitted from these surfaces when the apparatus is placed in various horizontal or vertical orientations such as vertically between couch cushions; or horizontally between a bed mattress and box spring; or on a picnic blanket. Multiple stemmed and non-stemmed beverage container types such as wine glasses, coffee cups, large soda cups are simultaneously held. Additional storage space for personal effects such as digital electronic devices, remote controls or reading glasses is included. One embodiment of the invention includes speakers, amplifying electronics and batteries for playing digital music from a users digital electronic device.

4 Claims, 7 Drawing Sheets

(56) References Cited

U.S. PATENT DOCUMENTS

| | | | | |
|---|---|---|---|---|
| 6,945,502 | B2 * | 9/2005 | Restifo | 248/146 |
| 7,089,876 | B2 * | 8/2006 | Porat | 114/222 |
| 7,731,144 | B2 * | 6/2010 | Kazyaka | 248/311.2 |
| D625,975 | S * | 10/2010 | Long | D8/45 |
| D652,228 | S * | 1/2012 | Silver et al. | D6/429 |
| 8,397,963 | B2 * | 3/2013 | Singh | 224/275 |
| 8,573,553 | B2 * | 11/2013 | Stephan | 248/311.2 |
| 2003/0141424 | A1 * | 7/2003 | Thomas | 248/311.2 |
| 2006/0278790 | A1 * | 12/2006 | Park | 248/311.2 |
| 2006/0278791 | A1 * | 12/2006 | Jackson et al. | 248/311.2 |
| 2012/0305716 | A1 * | 12/2012 | McKay et al. | 248/146 |

* cited by examiner

MULTIFUNCTION BEVERAGE CONTAINER HOLDER

CROSS-REFERENCES TO RELATED APPLICATIONS

Not Applicable

STATEMENT REGARDING FEDERALLY SPONSORED RESEARCH OR DEVELOPMENT

Not Applicable

NAMES OF PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION 1.0 Field of the Invention

The present invention relates generally to beverage container holders adaptable for use with multiple beverage containers, and in multiple soft and hard surfaced locations including couches, beds, vehicles and picnic blankets over grass.

2.0 Description of the Related Art

People frequently enjoy various types of beverages in multiple different locations. These locations could include sitting or lying on couches of varying cushion thickness to read, watching TV in bed, having picnics on a blanket covering a grassy field, resting on the beach sand and driving in a vehicle. Furthermore, one person may be drinking from a traditional handled coffee mug, while another may be drinking from a stemmed beverage container including, but not limited to, a wine glass, and both desire a unified convenient location to rest their different beverage containers. Additionally, while enjoying the beverage it is desirable to be able to listen to digital music in these same locations and store personal effects including, but not limited to, remote controls. However, all these locations present unstable beverage container holder bearing surfaces with a high probability of spilling since all previous beverage container holders are designed with large contact surfaces between the beverage container holder and the support or bearing surfaces. These large contact areas then transfer large forces from the supporting surface to the beverage container resting in the beverage container holder, thereby increasing the likelihood of liquid spilling.

Various beverage container holders or digital music players have been designed to fit into existing car beverage container holders, or sit on top of couch cushions, or be placed between couch cushions for support. For example, US Pat. App. No. 2011/0286622 A1 describes a speaker device insertable into an existing vehicle beverage container holder. However, this invention does not include the ability to hold beverages, it simply enables playing of digital music via a speaker device mounted into a vehicle beverage container holder.

U.S. Pat. No. 5,199,678 describes a beverage container holder capable of being mounted on the arm of a chair and hanging from said arm. However, this invention also does not remove the spilling forces from being transmitted to the beverage container, it also does not allow deployment on vertical locations such as between a bedspring and mattress, or provide the user with a digital music listening capability, or provide a convenient storage area for personal items, or support multiple beverage container designs.

U.S. Pat. No. 7,556,230 B2 describes a beverage container holder designed to rest on a horizontal surface such as a couch cushion or table. However, this invention does not isolate the beverage from the external spilling forces, it also does not allow deployment on vertical locations such as between a bedspring and mattress. It also does not facilitate digital music playing or personal item storage.

U.S. Pat. No. 8,231,094 B1 describes a beverage container holder capable of being clamped to various surfaces however it does not enable the user to rest a beverage on a horizontal or vertical surface, or isolate the beverage from spilling forces, or provide personal effects storage, or digital music playing.

Beverage container holder prior art embodiments do not facilitate use of the beverage container holder in multiple horizontal and vertically mounted locations and do not mitigate transmission of beverage spilling forces from the mounting location. The prior art also fail to simultaneously accommodate both stemmed and non-stemmed beverage containers including, but not limited to, both stemmed wine glasses and non-stemmed coffee cups, or provide a storage location for personal items including, but not limited to, remote control players and eyeglasses, and also fail to accommodate digital music players and speakers.

In view of the foregoing, a multifunction beverage container holder is desired which provides stable support for multiple beverage container forms including, but not limited to, coffee cups, wine glasses and convenience store "go cups"; storage for personal items including, but not limited to, mp3 players, remote controls, pens, reading glasses; beverage support in multiple orientations and on multiple stable or unstable surfaces and bearing locations; and enabling amplification and transmission of digital music to the proximate person. This multifunction beverage container holder is described more particularly in the following text.

The foregoing examples of related art and limitations related therewith are intended to be illustrative and not exclusive, and they do not imply any limitations on the inventions described herein. Other limitations of the related art will become apparent to those skilled in the art upon a reading of the specification and a study of the drawings.

BRIEF SUMMARY OF THE INVENTION

The following embodiments and aspects thereof are described and illustrated in conjunction with systems, tools and methods, which are meant to be exemplary and illustrative, not limiting in scope. In various embodiments, one or more of the above-described problems have been reduced or eliminated, while other embodiments are directed to other improvements.

An embodiment of the present invention proposes to reduce or overcome one or more of the problems or shortcomings inherent in prior beverage container holder art, and further to provide a more useful and highly accepted improved multifunction beverage container holder.

To achieve these and other advantages and in accordance with the purpose of the present invention, as embodied and broadly described, the present invention provides an apparatus that will simultaneously accept both stemmed beverage containers including, but not limited to, wine glasses, and non-stemmed beverage containers including, but not limited to, coffee cups and large convenience store soda cups; is portable, stable and mitigates spilling of the held beverages; can be conveniently utilized in multiple locations including, but not limited to, a couch, bed, picnic blanket, vehicle, beach sand; enables storage of personal effects such as remote controls; facilitates playing of music from a digital music player, and incorporates locations for indices including, but not limited to, team logos or names.

One embodiment of the present invention is directed to an apparatus that maintains one or more beverage containers in an upright position on multiple stable and unstable surfaces and in multiple orientations both horizontally including, but not limited to, between bed mattress and box springs and vertically including, but not limited to, between couch cushions of varying thickness or impressed into beach sand, wherein the multifunction beverage container holder housing is removed from direct contact with the bearing or support surface through the use of slender supporting elongated shafts, commonly known as legs, which can be attached to the beverage container holder housing in multiple horizontal and vertical orientations. These elongated shafts also mitigate the influence of external beverage spilling forces by minimizing the contact area between the elongated shaft and the support or bearing surface and also by distancing the main beverage container holder housing from contact with the bearing or support surface forces. Additional spillage force damping can be obtained by inserting springs or similar force damping apparatus between the supporting elongated shafts and the beverage container holder housing.

Additional features and advantages of the invention may be learned by practice of the invention, and will be set forth in the descriptions that follow and in part will be apparent from the description and accompanying figures which illustrate by way of example the principles of the invention. The objectives and other advantages of the invention will be realized and attained by the structure particularly pointed out in the written description and claims thereof as well as the appended drawings. It is understood that both the foregoing general description and the following detailed description are exemplary and explanatory and are intended to provide further explanation of the invention as claimed, and include example implementations which are not a limiting statement of the scope of the invention.

BRIEF DESCRIPTION OF THE SEVERAL VIEWS OF THE DRAWINGS

The accompanying drawings, which are incorporated herein and form a part of the specification, illustrate some, but not the only or exclusive, example embodiments and/or features. It is intended that the embodiments and figures disclosed herein are to be considered illustrative rather than limiting.

REFERENCE NUMERALS IN THE DRAWINGS

Figure 1:
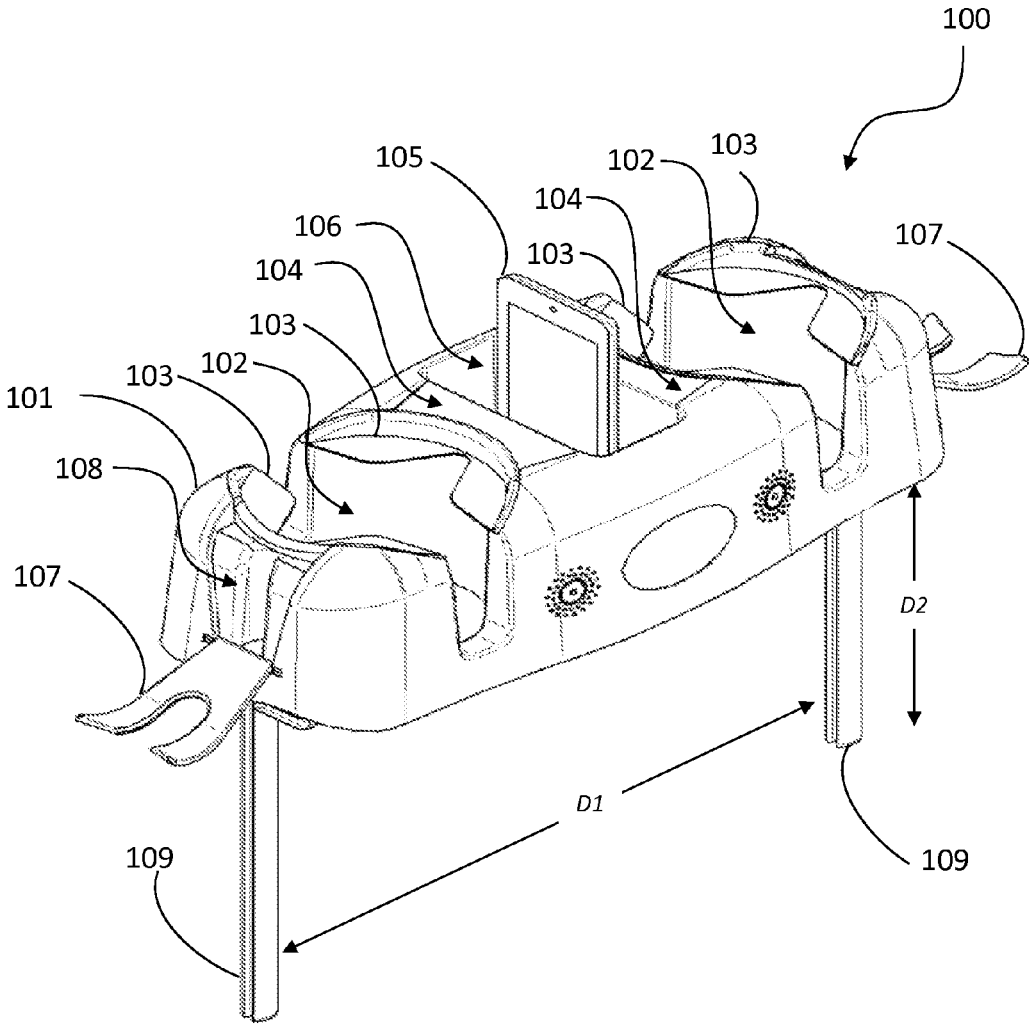
FIG. 1 depicts a front perspective view of the beverage container holder with the deployable stemmed beverage container support arms in the storage position and the supporting elongated shafts inserted in the vertical configuration

| | |
|---|---|
| 100 | multifunction beverage container holder |
| 101 | beverage container holder housing |
| 102 | beverage container receptacle |
| 103 | flexible beverage container support |
| 104 | sloped top surface |
| 105 | digital music player |
| 106 | personal effects storage receptacle |
| 107 | deployable stemmed beverage container support arm |
| 108 | stemmed beverage container support arm recessed storage area |
| 109 | elongated shaft |
| 200 | beverage container holder speaker |
| 201 | sound amplification electronics and batteries compartment |
| 202 | elongated shaft receiving cavity |
| 203 | raised bottom surface platform |
| 204 | receiving cavity key |
| 205 | hole between top and bottom surfaces |
| 300 | vertical slot |
| 301 | multiple sound transmission orifices |
| 302 | indicia area |
| 303 | elongated shaft stub B |
| 400 | elongated shaft stub C |
| 600 | stemmed beverage container support arm fingers |
| 601 | stemmed beverage container slot |
| 602 | hinge rod receptacle |
| 603 | flexible support barb |
| 604 | flexible support barb flanged section |
| 605 | flexible retainer tab |
| 606 | flexible retainer recessed area |
| 607 | flexible retainer friction surface |
| 608 | flexible support barb receiving hole |
| 700 | sloped horizontal support ledge |
| 701 | hinge rod |
| 800 | elongated shaft stub A |
| 801 | rounded end |
| 802 | keyway |

DETAILED DESCRIPTION OF THE INVENTION

The present invention will now be described in detail with reference to the embodiments thereof as illustrated in the accompanying drawings. In the following description, numerous specific details are set forth in order to provide a thorough understanding of the present invention. It will be apparent, however, to one skilled in the art, that the present invention may be practiced without some or all of the specific details. In other instances, well known operations have not been described in detail so not to unnecessarily obscure the embodiments of the present invention. It is intended that the embodiments and figures disclosed herein are to be considered illustrative rather than limiting.

A preferred, but not limiting, embodiment relates to a multifunction beverage container holder apparatus containing one or more beverage container receptacles capable of maintaining stemmed or non-stemmed beverage containers in an upright position while mitigating or damping transmission of beverage spilling forces from the support or bearing surface to the beverage container by separating the beverage container holder housing from direct contact with the support or bearing surface and minimizing the beverage container holder elongated shaft contact area with the support or bearing surface. The beverage container holder can also be positioned in multiple horizontal and vertical locations, including unstable bearing or supporting surfaces. The beverage container holder for example could be vertically positioned above the cushions of a couch and raised off the couch cushions by two elongated shafts. The beverage container holder elongated shafts could also be pressed vertically into beach sand, thus raising the beverage container holder off the sand by the two elongated shafts. The beverage container holder could also be horizontally supported between a bed mattress and box spring and separated from the mattress by two elongated shafts, or clamped onto a bicycle handlebar by inserting the horizontally configured elongated shafts into a clamping device attached to the handlebars. The beverage container holder could also be stabilized by inserting the two elongated shafts in opposing directions thereby minimizing, or damping, tipping forces transmitted from an unstable surface including, but not limited to, a picnic blanket or grass.

Due to the reduced contact area presented to the bearing or supporting surface by the slim elongated shalt design, the elongated shafts then mitigate, or dampen, transmission of beverage spilling forces both laterally and vertically from the supporting or bearing surface into the beverage container holder, thereby providing greater beverage container stability and minimizing beverage spillage. Additional force damping may be obtained by utilizing damping apparatuses including, but not limited to, springs or elastomeric compounds connecting the supporting elongated shafts and beverage container holder housing.

In another embodiment, one or more deployable stemmed beverage container support arms are rotated into the horizontal deployed position and provide support for stemmed beverage containers including, but not limited to, wine glasses, while non-stemmed beverage containers including, but not limited to, coffee cups and large convenience store cups can be simultaneously supported in the central one or more beverage container receptacles. Alternately, these deployable stemmed beverage container support arms could be fixed in the horizontal deployed position to provide the required stemmed beverage container support.

FIG. 1 illustrates a perspective view of a beverage container holder according to one embodiment of the present invention. The beverage container holder includes the beverage container holder housing 101 which has a sloped top surface 104 inclined to enable spilled liquids to run into the beverage container receptacles 102. The beverage container holder housing 101 also incorporates one or more beverage container receptacles 102 which include multiple flexible beverage container support 103 devices designed to provide lateral support holding the beverage container in an upright orientation.

Beverage container holder housing 101 also incorporates multiple stemmed beverage container support arm recessed storage areas 108 for storing a beverage container holding apparatus including, but not limited to, multiple deployable stemmed beverage container support arms 107. When rotated into the horizontal deployed position, the deployable stemmed beverage container support arm 107 is intended to support stemmed beverage containers including, but not limited to, wine glasses and brandy snifters. The beverage container holder housing 101 also incorporates a recessed personal effects storage receptacle 106 sized to receive and hold personal effects including, but not limited to, digital music players, TV remote controls, or reading glasses.

In one embodiment illustrated in FIG. 1, each elongated shaft 109 is inserted vertically into the beverage container holder housing 101, separated by a distance D1 and is placed between vertical support or bearing surfaces including, but not limited to, couch cushions or pressed into a substrate including, but not limited to, beach sand or soil to provide a standoff spacing D2 between the beverage container holder housing 101 and the support or bearing surface. The two elongated shafts 109 function to distance the beverage container holder housing 101 from the vertical supporting or bearing surfaces in order to mitigate transmission of support or bearing surface motion to the beverage container holder housing 101, thereby minimizing beverage spillage.

Figure 2:
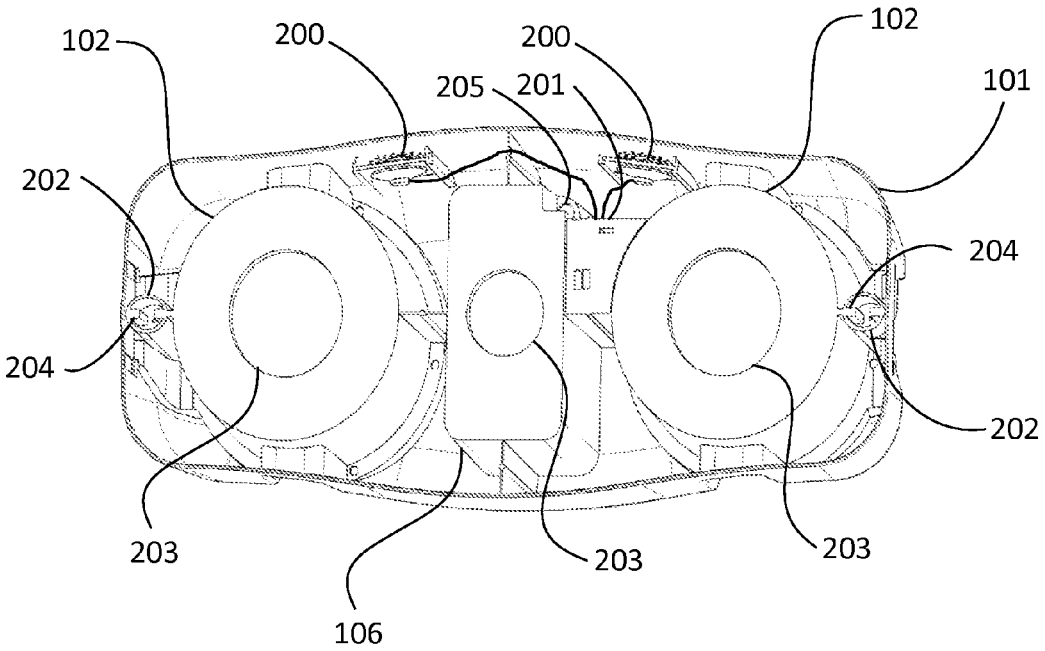
FIG. 2 depicts a bottom view of the beverage container holder housing with the elongated shafts removed

FIG. 2 illustrates a bottom surface view of the beverage container holder housing 101, including the elongated shaft receiving cavity 202 and a receiving cavity key 204. Said elongated shaft receiving cavity 202, is sized and shaped to receive elongated shaft 109. Alternate embodiments of the elongated shaft receiving cavity 202 could have many geometric forms including, but not limited to, round, hexagonal and square.

Each beverage container receptacle 102, and the recessed personal effects storage receptacle 106 have a raised bottom surface platform 203 which protrudes into the cavity and provides a resting surface for inserted objects, thereby raising the inserted object above any liquids spilled into the beverage container receptacle 102 or personal effects storage receptacle 106.

One embodiment of the invention includes a sound amplification electronics and batteries compartment 201 placed within the beverage container holder housing 101 and connected via wires or wirelessly to beverage container holder speakers 200 which are affixed to the beverage container holder housing 101. The sound amplification electronics and batteries are also connected wirelessly or with wires which pass through a hole between top and bottom surfaces 205 into the personal effects storage receptacle 106 and can be connected to the digital music player 105, in FIG. 1.

Figure 3:
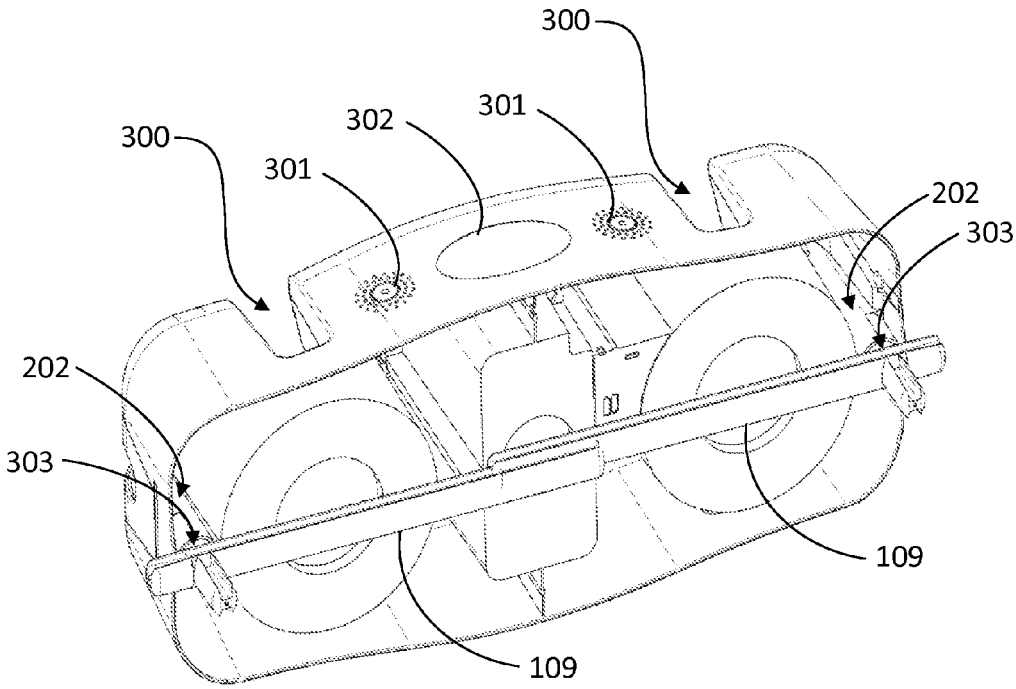
FIG. 3 depicts a bottom perspective view of the beverage container holder housing with the supporting elongated shafts inserted in the storage configuration

FIG. 3 illustrates one embodiment of the invention wherein the beverage container holder housing 101 also includes multiple vertical slots 300 to accommodate beverage containers with side handles including, but not limited to, coffee cup handles. The vertical side of the beverage container holder housing 101 is provided with an indicia area 302 for placement of indicia including, but not limited to, team logos and names. The vertical side of the beverage container holder housing 101 also contains multiple sound transmission orifices 301, or is partially made of a mesh material, to facilitate propagation of the sound from internal speakers.

FIG. 3 also illustrates one embodiment of the invention wherein the elongated shaft stub 303 of each elongated shaft 109 is inserted into the elongated shaft receiving cavity 202 wherein each elongated shaft 109 is pointed towards the other and offset by a slight rotation angle of elongated shaft stub 303, thus creating a compact storage form.

Figure 4:
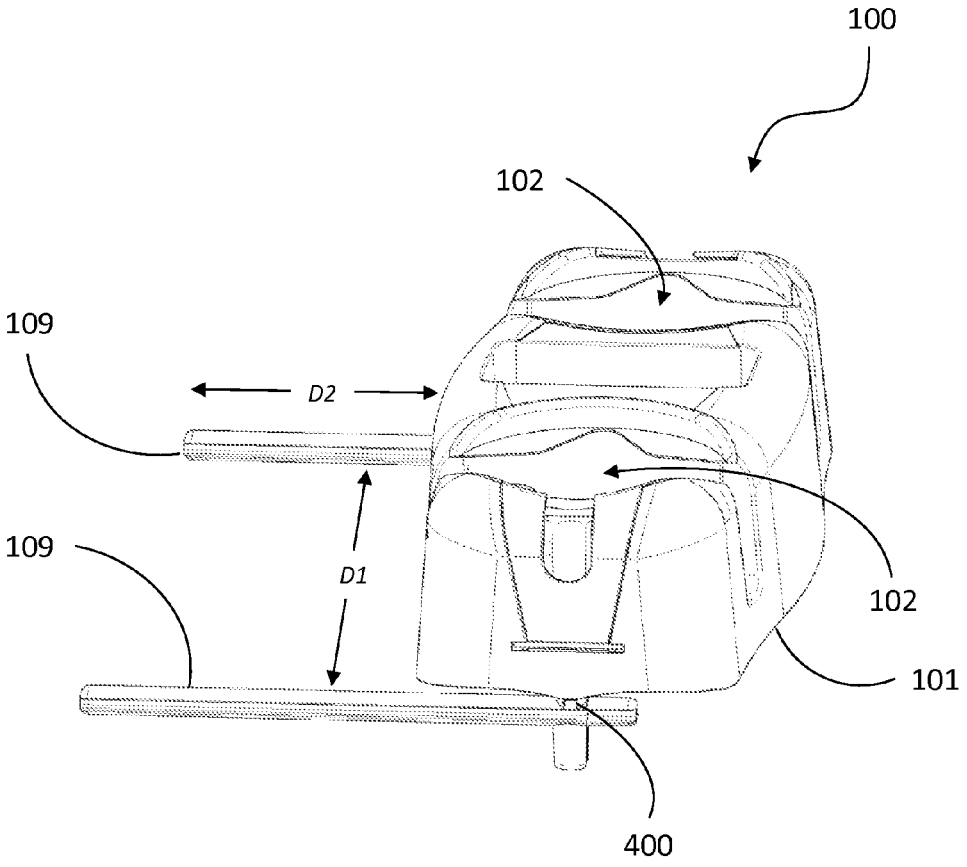
FIG. 4 depicts a top perspective view of the beverage container holder with the deployable stemmed beverage container support arms in the stowed position and the supporting elongated shafts inserted in the horizontal configuration

FIG. 4 illustrates another embodiment of the invention, wherein the elongated shaft stub 400 of each elongated shaft 109 is inserted into the elongated shaft receiving cavity 202, of FIG. 2, and extend in an approximate 90 degree angle from an axial line through the one or more beverage container receptacles 102. Each elongated shaft 109 is separated by a distance D1 and placed between horizontal support or bearing surfaces including, but not limited to, mattresses and box springs to provide a standoff spacing D2 between the beverage container holder housing 101 and the support or bearing surface. The elongated shaft 109 functions to distance the beverage container holder housing 101 from the horizontal supporting or bearing surfaces in order to mitigate transmission of support or bearing surface motion to the beverage container holder housing 101, thereby minimizing beverage spillage. In other embodiments, the elongated shaft 109 could be clamped to horizontal surfaces, including but not limited to, bicycle handlebars, fence top rails, and similar bearing surfaces.

Figure 5:
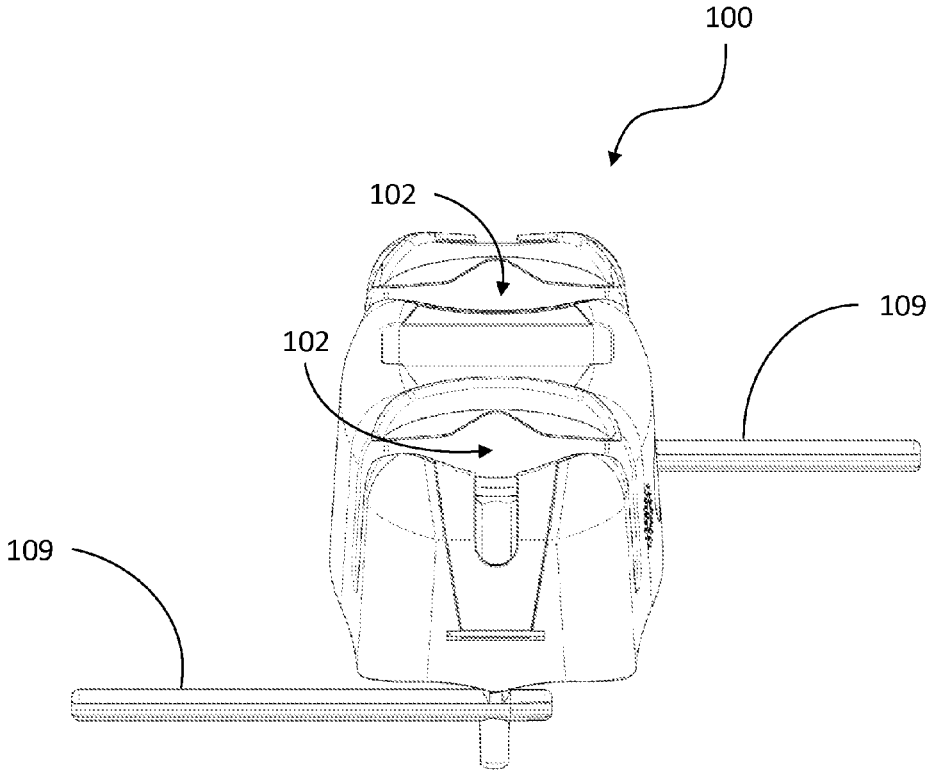
FIG. 5 depicts a top perspective view of the beverage container holder with the deployable stemmed beverage container support arms in the storage position and the supporting elongated shafts inserted in the horizontal opposing configuration

FIG. 5 illustrates another embodiment of the invention, wherein the elongated shaft 109 is inserted into the elongated shaft receiving cavity 202, of FIG. 2, in a configuration where each elongated shaft is positioned in an opposing orientation and both are at an approximate 90 degree angle from an axial line through the one or more beverage container receptacles 102. When configured in this embodiment, each elongated shaft 109 forms a stabilizing platform when the multifunction beverage container holder 100 is placed on an unstable surface including, but not limited to, a picnic blanket, grass, pillow, or car seat.

Figure 6:
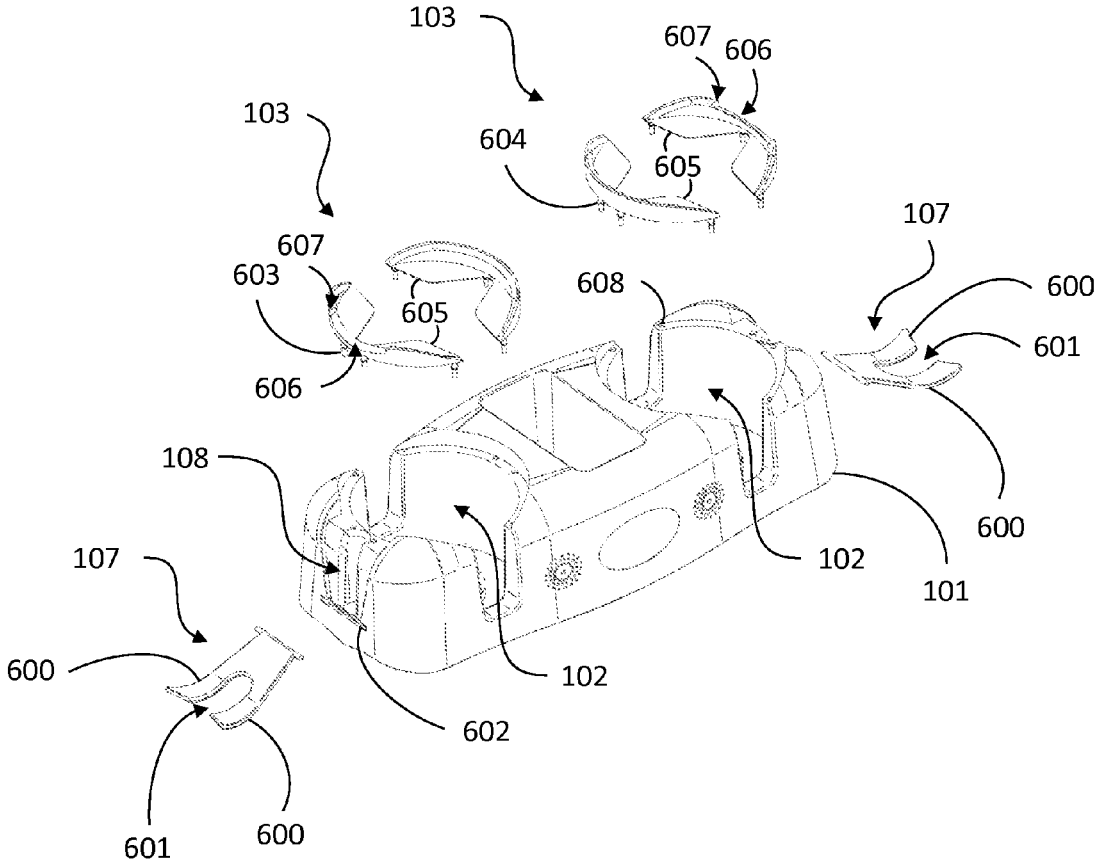
FIG. 6 depicts an exploded view of the beverage container holder housing with the elastomeric beverage retainer supports and the deployable stemmed beverage container support arms detached and the elongated shafts removed

FIG. 6 illustrates an exploded view of one embodiment of the beverage container holder housing 101 wherein multiple flexible beverage container support 103 devices are connected to the beverage container housing 101 by inserting multiple flexible supporting barbs 603 into multiple flexible support barb receiving holes 608 in the beverage container holder housing 101 surrounding the one or more beverage container receptacles 102. The flexible beverage container supports 103 incorporate multiple flexible retainer tabs 605 that protrude into the beverage container receptacle 102 and touch the beverage container thereby providing lateral stabilizing forces on the beverage container. One embodiment of the flexible beverage container support 103 device includes multiple flexible support barbs 603 having an overall conical shape with a diameter slightly smaller than the diameter of the flexible support barb receiving hole 608. The flexible support barb 603 incorporate a flexible support barb flanged section 604 protruding in a lateral manner perpendicular to the long flexible support barb 603 axis. This flanged section 604 has a diameter larger than the flexible support barb receiving hole 608 diameter. The flexible support barb 603 is pushed through the flexible support barb receiving hole 608 which compresses the flexible support barb flanged section 604 while traversing the flexible support barb receiving hole 608. Once through the flexible support barb receiving hole 608, the flexible support barb flanged section 604 naturally expands back to the larger diameter which provides a resisting force to external forces attempting to remove the flexible beverage container support 103 device. Alternate embodiments of the flexible retainer support 103 to beverage container holder housing 101 connection methodology could replace the hole and barb concept with a slot in the beverage container holder housing 101 which surrounds the beverage container receptacle 102. This slot is designed to receive a "T" shaped support molded into the underside of the flexible beverage container support 103. This and related connection methodologies fall within the scope and intent of this device.

One embodiment of the flexible beverage container support 103 device includes a flexible retainer recessed area 606 which receives the deployable stemmed beverage container support arm 107 stemmed beverage container support arm fingers 600, and provides a resistive friction retaining force along the vertical flexible retainer friction surface 607 when the deployable stemmed beverage container support arm 107 is stored in the stemmed beverage container support arm recessed storage area 108 of beverage container holder housing 101.

The deployable stemmed beverage container support arm 107 is formed of parallel stemmed beverage support arm fingers 600 which may be curved in multiple axes to approximately match curvature of the stemmed beverage container and also the exterior surface of the beverage container holder housing 101, and also includes a stemmed beverage container slot 601 enabling insertion of the stem of a beverage container including, but not limited to, a wine glass or brandy snifter.

Figure 7:
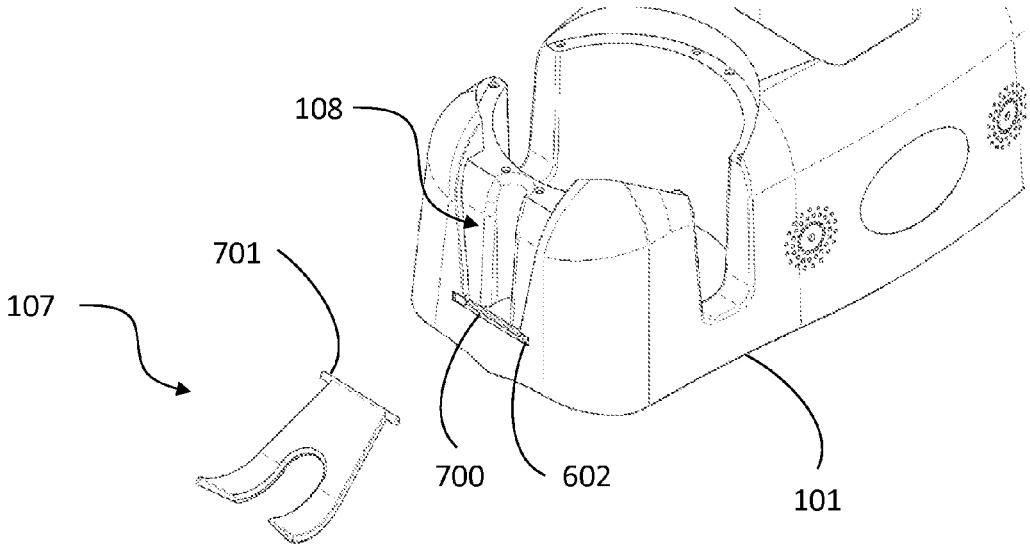
FIG. 7 depicts an exploded view of the deployable stemmed beverage container support arm and stemmed beverage container support arm recessed storage area

FIG. 7 illustrates one embodiment of the beverage container holder housing 101 wherein the deployable stemmed beverage container support arm 107 is connected to the beverage container holder housing 101 via an integral hinge rod 701 which snaps into the hinge rod receptacle 602 in the beverage container holder housing 101 thereby enabling rotation of the deployable stemmed beverage container support arm 107 from the stemmed beverage container support arm recessed storage area 108 into an approximate 90 degree deployed position, thereby resting on a sloped horizontal support ledge 700 in the beverage container holder housing 101 and providing vertical support for stemmed beverage containers including, but not limited to, wine glasses or brandy snifters.

Alternate deployable stemmed beverage container support arm 107 embodiments could include integral hinges and other devices enabling rotation around an axis, adhesive compounds enhancing friction between the deployable stemmed beverage container support arm 107 and the stemmed beverage container, or the deployable stemmed beverage container support arms 107 could simply be fixed in place on the beverage container holder housing 101.

Figure 8:
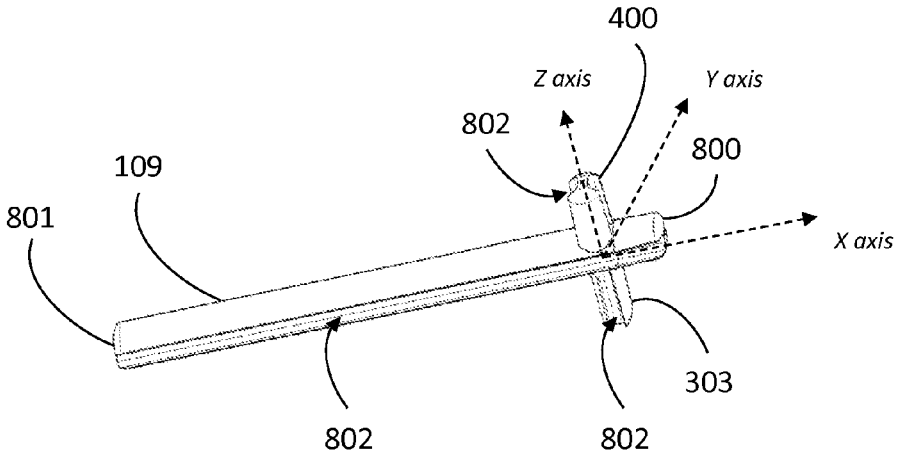
FIG. 8 depicts a side perspective view of the beverage container holder elongated shaft and end adaptations

FIG. 8 illustrates an embodiment of the removable elongated shaft 109 wherein the elongated shaft has an oval cross section to provide greater support stiffness and enhance the stability of the beverage container holder housing 101 when said beverage container holder housing 101 is supported from bearing surfaces including, but not limited to, couch cushions or bed mattresses. In other embodiments, elongated shaft stubs 800, 303 and 400 could have many geometric forms including, but not limited to, round, hexagonal and square.

The elongated shaft 109 may incorporate a keyway 802 along the X axis and includes rounded ends 801 to facilitate insertion between bearing surfaces, including but not limited to, couch cushions and bed mattresses, and also facilitate insertion into the elongated shaft receiving cavity 202, FIG. 2. One end of the elongated shaft is formed of three stubs positioned in a cross shaped orientation where the X axis follows the elongated shaft centerline through elongated shaft stub 800, the Y axis is perpendicular to the X axis, and the Z axis is perpendicular to the X and Y axes through elongated shaft stub 303 and 400. Elongated shaft stub 800 extends axially along the X axis and can be inserted into elongated shaft receiving cavity 202, FIG. 2, to support the beverage container holder housing 101 in a vertical position as shown in FIG. 1. Elongated shaft stub 303 is rotated approximately 90 degrees counter clockwise around the Y axis and is rotated slightly less than 90 degrees clockwise around the Z axis to enable storing the elongated shaft 109 in the elongated shaft receiving cavity 202 as illustrated in FIG. 3. Elongated shaft stub 400 is located opposite elongated shaft stub 303 and is rotated approximately 90 degrees clockwise around the Y axis from elongated shaft stub 800, thereby enabling the elongated shaft 109 to be inserted into the elongated shaft receiving cavity 202, FIG. 2, creating elongated shaft 109 orientations of either FIG. 4 or FIG. 5.

The multifunction beverage container holder 100 herein described may be manufactured from injection molded plastics and elastomeric materials including, but not limited to, nylon or polyethylene, however other suitable materials including, but not limited to, stamped aluminum or machined steel may alternatively be employed.

The foregoing description of the invention has been presented for purposes of illustration and description and is not intended to be exhaustive or to limit the invention to the precise form disclosed. It will be apparent to those skilled in the art that there are various alterations, permutations, and equivalents, which fall within the scope of this invention and may be possible in light of the above teachings. The embodiments were chosen and described in order to best explain the principles of the invention and its practical application to thereby enable others skilled in the art to best utilize the invention in various embodiments and various modifications as are suited to the particular use contemplated. It should also be noted that there are many alternative ways of implementing the methods and apparatus of the present invention. It is therefore intended that the following appended claims be interpreted as including all such alternates, permutations, equivalents and alternative embodiments as fall within the true spirit and scope of the present invention except insofar as limited by the prior art.

I claim:

1. A portable multifunction beverage container holder comprising:

a free-standing beverage container holder housing having a top surface and a bottom surface connected via side surfaces and having (i) at least one beverage container receptacle formed as a recessed cavity within said top surface that is sized and shaped to receive and hold a beverage container and position said beverage container in a substantially upright position;

at least two receiving cavities on said bottom surface of said beverage container holder housing;

at least two elongated shaft structural supports, each of which has a first end that extends along a longitudinal axis of the elongated shaft structural support and is sized and shaped for insertion into at least one of the shaft receiving cavities and at least one stub that extends along a second axis which is transverse to the longitudinal axis of the elongated shaft structural support and that terminates in a size and shape for insertion into at least one of the shaft receiving cavities; and wherein said beverage container holder housing has at least one deployable stemmed beverage container support arm attached to said beverage container holder housing for providing lateral and vertical support to a bowl of a stem on a stemmed beverage container in which the stem of the beverage container connects a base section to the bowl section of the stemmed beverage container, and wherein said deployable stemmed beverage container support arm pivots from a storage location on a lateral side of the beverage container holder housing into a use location, wherein the stemmed beverage container support arm is deployed to a position extending outward from the beverage container holder housing such that the stemmed beverage container support arm bears on the bowl of a stemmed beverage container that is positioned in the upright in the deployable beverage container support arm to contain a beverage in the upright bowl section of the stemmed beverage container.

2. The portable multifunction beverage container holder of claim 1, wherein said deployable stemmed beverage container support arm is comprised of a base hinge rod inserted into said beverage container holder housing and slotted fingers attached on said hinge rod for supporting at least one stemmed beverage container when said deployable stemmed beverage container support arm is deployed in a horizontal position and rested on a ledge formed into said beverage container holder housing.

3. The portable multifunction beverage container of claim 1, wherein each of the at least two elongated shaft structural supports includes at least a second stub that terminates in a size and shape for fitting insertion into at least one of the shaft receiving cavities.

4. The portable multifunction beverage container of claim 1, wherein the second axis is perpendicular to the longitudinal axis.

* * * * *